US010883765B2

(12) United States Patent
Lewandowski et al.

(10) Patent No.: US 10,883,765 B2
(45) Date of Patent: Jan. 5, 2021

(54) HEAT EXCHANGER WITH HEILICAL FLIGHTS AND TUBES

(71) Applicant: Hamilton Sundstrand Corporation, Charlotte, NC (US)

(72) Inventors: Dawid Lewandowski, Oleśnica (PL); Artur Hilgier, Legnica (PL); Rafal Lewandowski, Żarów (PL)

(73) Assignee: HAMILTON SUNSTRAND CORPORATION, Charlotte, NC (US)

( * ) Notice: Subject to any disclaimer, the term of this patent is extended or adjusted under 35 U.S.C. 154(b) by 88 days.

(21) Appl. No.: 15/726,671

(22) Filed: Oct. 6, 2017

(65) Prior Publication Data

US 2018/0100704 A1 Apr. 12, 2018

(30) Foreign Application Priority Data

Oct. 7, 2016 (EP) ..... 16461562

(51) Int. Cl.
*F28D 7/02* (2006.01)
*F28F 9/22* (2006.01)
(Continued)

(52) U.S. Cl.
CPC ..... *F28D 7/026* (2013.01); *F28D 7/16* (2013.01); *F28F 9/0209* (2013.01); *F28F 9/22* (2013.01);
(Continued)

(58) Field of Classification Search
CPC ..... F28D 7/02; F28D 7/026; F28D 7/1669; F28D 9/0025; F28D 7/1169; F28D 7/022;
(Continued)

(56) References Cited

U.S. PATENT DOCUMENTS 97,865 A * 12/1869 Bourne ..... F24H 1/38 122/215
447,285 A 3/1891 Perry
(Continued)

FOREIGN PATENT DOCUMENTS

CN 1719187 A 1/2006
CN 102538562 A 7/2012
(Continued)

OTHER PUBLICATIONS

Extended European Search Report for International Application No. 16461562.7 dated Feb. 24, 2017, 6 pages.
(Continued)

*Primary Examiner* — Travis C Ruby
*Assistant Examiner* — Harry E Arant
(74) *Attorney, Agent, or Firm* — Cantor Colburn LLP

(57) ABSTRACT

A heat exchanger comprises a shell having a first inlet and a first outlet for a first fluid (H) and a second inlet and a second outlet for a second fluid (C), and a screw element. The screw element has a core and first and second nested helical flights mounted to the core. The helical flights define first and second helical fluid passages along the shell. The first fluid passage is in fluid communication with the first inlet and the first outlet and the second fluid passage is in fluid communication with the second inlet and the second outlet. The heat exchanger further comprises a plurality of tubes mounted between adjacent turns of the first and second helical flights and extending across the fluid flow passage formed between the helical flights for conducting the first and or second fluid.

18 Claims, 9 Drawing Sheets

(51) Int. Cl.
*F28D 7/16* (2006.01)
*F28F 27/02* (2006.01)
*F28F 9/02* (2006.01)

(52) U.S. Cl.
CPC ..... *F28F 27/02* (2013.01); *F28F 2009/0287* (2013.01); *F28F 2009/228* (2013.01); *F28F 2250/06* (2013.01); *F28F 2255/02* (2013.01); *F28F 2265/12* (2013.01)

(58) Field of Classification Search
CPC .. F28F 9/02; F28F 9/0209; F28F 3/025; F28F 9/22; F28F 9/0287; F28F 2265/12; F28F 2250/06; Y01S 165/355
See application file for complete search history.

(56) References Cited

U.S. PATENT DOCUMENTS

| | | | | |
|---|---|---|---|---|
| 1,335,506 | A | 3/1920 | Jones | |
| 1,673,918 | A * | 6/1928 | Mauran | F28D 7/026 122/183 |
| 2,809,810 | A * | 10/1957 | Carroll, Jr. | F01M 5/007 165/279 |
| 2,996,600 | A * | 8/1961 | Gardner, Jr. | B23K 9/0288 219/137 R |
| 3,400,758 | A | 9/1968 | Lee | |
| 4,360,059 | A | 11/1982 | Funke | |
| 4,697,321 | A | 10/1987 | Shibuya et al. | |
| 4,699,211 | A | 10/1987 | Geary et al. | |
| 4,897,908 | A * | 2/1990 | Henriksson | B21D 39/06 29/445 |
| 5,094,088 | A * | 3/1992 | Davis | B67D 7/80 165/164 |
| 5,242,011 | A * | 9/1993 | Hesse | F01P 11/18 137/539 |
| 6,827,138 | B1 | 12/2004 | Master et al. | |
| 8,540,011 | B2 | 9/2013 | Wang et al. | |
| 2008/0190593 | A1 | 8/2008 | Wang et al. | |
| 2014/0262171 | A1 | 9/2014 | Ljubicic | |
| 2016/0018168 | A1 | 1/2016 | Urbanski | |

FOREIGN PATENT DOCUMENTS

| | | | |
|---|---|---|---|
| CN | 203349686 | U | 12/2013 |
| CN | 103486881 | B | 7/2015 |
| DE | 2846455 | B1 | 10/1979 |
| DE | 102004012607 | A1 | 10/2005 |
| DE | 102005010261 | A1 | 9/2006 |
| GB | 732468 | A | 6/1955 |
| JP | S58217192 | A | 12/1983 |
| WO | 2005043061 | A1 | 5/2005 |
| WO | 2009036608 | A1 | 3/2009 |
| WO | 2009148822 | A2 | 12/2009 |
| WO | 2012003603 | A1 | 1/2012 |

OTHER PUBLICATIONS

Extended European Search Report for International Application No. 15461569.4 dated Apr. 7, 2016, 7 pages.
Extended European Search Report for Application No. 16461562.7, dated Jun. 20, 2017, 10 pages.

* cited by examiner

HEAT EXCHANGER WITH HEILICAL FLIGHTS AND TUBES

FOREIGN PRIORITY

This application claims priority to European Patent Application No. 16461562.7 filed Oct. 7, 2016, the entire contents of which is incorporated herein by reference.

TECHNICAL FIELD

The present disclosure relates to heat exchangers.

BACKGROUND

Heat exchangers are used in a wide range of applications and come in a variety of forms. In a basic form of heat exchanger, first and second fluid flows through the heat exchanger are separated from one another by a thermally conductive wall or walls, with heat being transferred from one fluid to the other through the separating wall.

It is desirable to provide a separating wall structure which improves heat transfer.

SUMMARY

There is disclosed herein a heat exchanger comprising a shell having a first inlet and a first outlet for a first fluid and a second inlet and a second outlet for a second fluid. The heat exchanger further comprises a screw element having a core and first and second nested helical flights mounted to the core and arranged within the shell to define first and second helical fluid passages along the shell between the first and second helical flights. The first fluid passage is in fluid communication with the first inlet and the first outlet and the second fluid passage is in fluid communication with the second inlet and the second outlet.

The heat exchanger may further comprise a plurality of tubes mounted between adjacent turns of the first and second helical flights and extending across the fluid flow passage formed between the helical flights for conducting the first and or second fluid from one turn of the first and second fluid flow passages to the adjacent turn of the first and second flow passages.

The tubes may be arranged in concentric circles around the axis of the screw element.

The tubes may alternatively or additionally be arranged in radially extending rows. The tubes for conducting the first fluid may be arranged radially between, for example approximately half way between, the tubes for conducting the second fluid in the same row.

Alternatively, the tubes for conducting the first fluid and the tubes for conducting the second fluid may be arranged in separate radially extending rows. The tubes conducting the first fluid may be arranged on different diameters from the tubes conducting the second fluid. For example, the tubes conducting the first fluid may be arranged on diameters approximately half way between the diameters of the tubes conducting the second fluid.

The tubes conducting the first fluid may have a greater cross sectional area than those conducting the second fluid. For example the tubes conducting a hot fluid may have a cross sectional area greater than those conducting a cold fluid.

The ends of the tubes may be flush with the surrounding surface of the respective flight, or may project therefrom. An opening, for an inlet opening, may be formed in the projecting portion of the tube end. The opening may be formed in an axially facing end of the tube. The end may be formed perpendicular to the axis of the tube or parallel to the adjacent surface of the helical flight. In an alternative arrangement, a portion of the end may be formed perpendicular to the tube axis and a further part formed at an angle thereto. In an alternative arrangement, the whole tube end may be formed at an angle to the tube axis. The angled part or wall may be planar or curved. In an alternative arrangement, the end of the tube may be closed, and an opening formed in a side wall of the projecting portion of the tube end. The opening may face the direction of fluid flow along the helical passage.

The tubes between successive respective turns may be aligned axially.

The tubes may be welded or brazed to the helical flights.

The tubes may be flexible or deformable.

The tubes may be formed in two parts, joined together.

The heat exchanger shell may comprise first and second end caps, the inlets and outlets being formed in the end caps.

The end caps may comprise a wall which divides the end cap into first and second plenums.

The heat exchanger may further comprise a bypass path for one or both of the first and second fluid flows.

The bypass path may be formed through the screw core.

The screw core may comprise first and second internal passages, each forming a portion of the bypass path.

The heat exchanger may further comprise a pressure relief valve arranged in the bypass path.

The pressure relief valve may be mounted in an end cap of the shell.

The internal surface of the shell may be formed with helical grooves to receive the helical flights.

BRIEF DESCRIPTION OF DRAWINGS

A non-limiting embodiment of this disclosure will now be described by way of example only with reference to the accompanying drawings in which.

DETAILED DESCRIPTION

Figure 1:
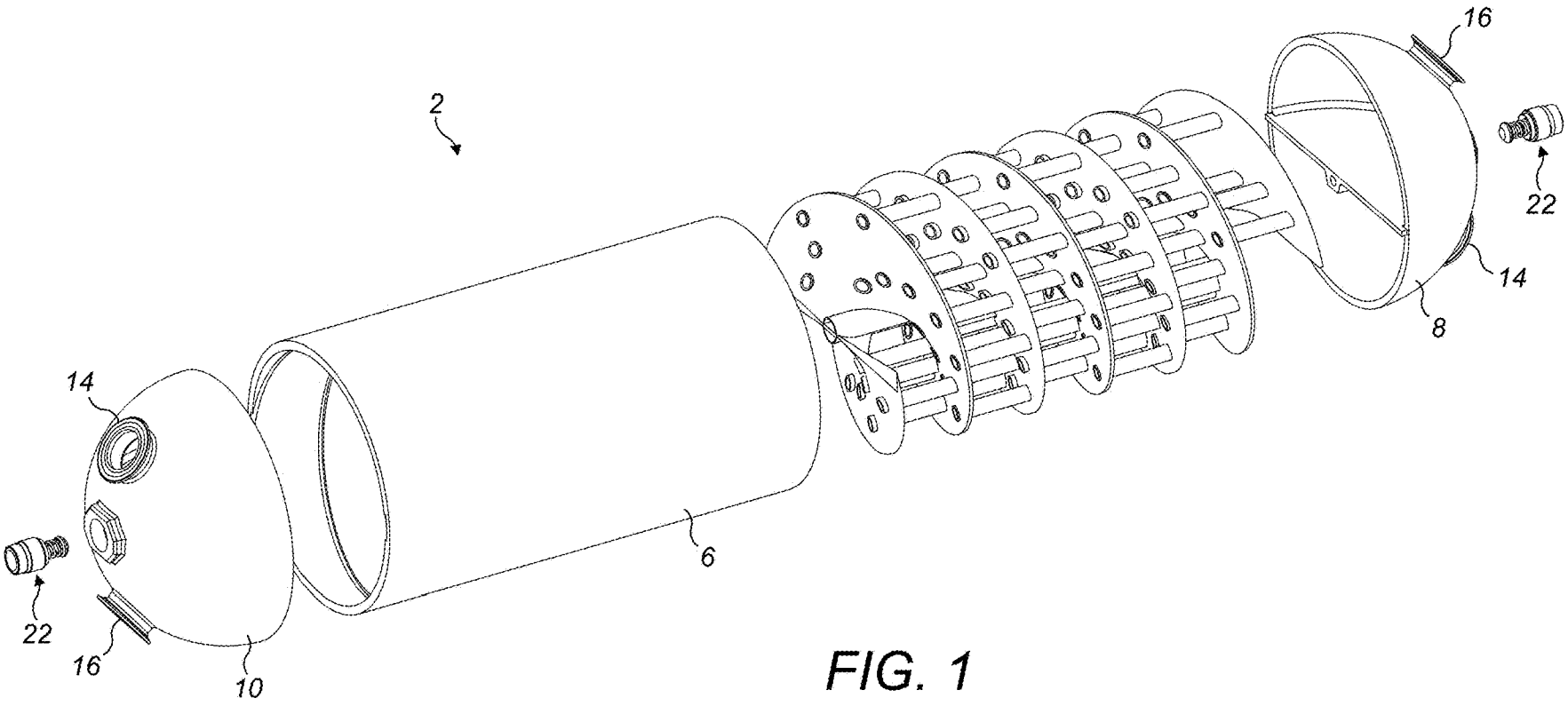
FIG. 1 shows an exploded perspective view of a shell heat exchanger in accordance with this disclosure.
Figure 2:
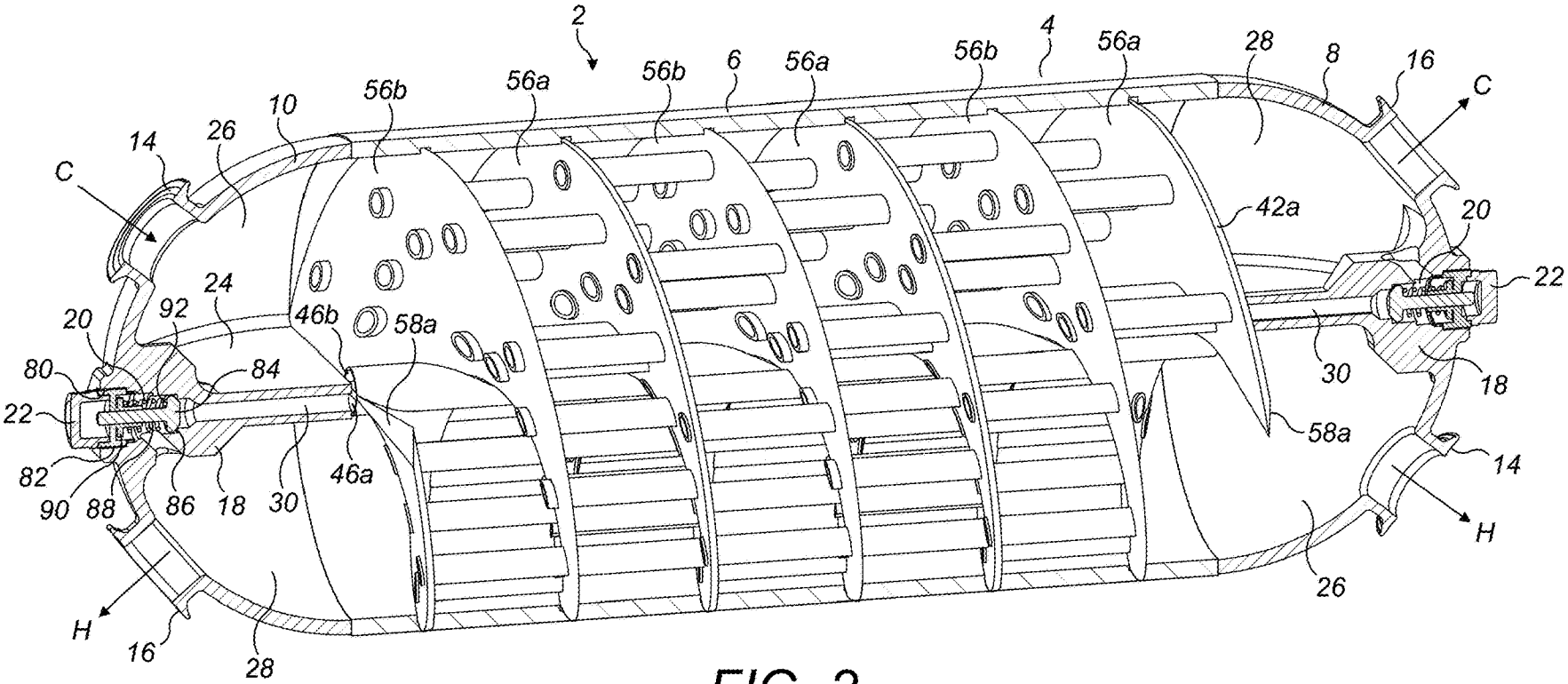
FIG. 2 shows a cut-away, part sectional perspective view of the heat exchanger.
Figure 3:
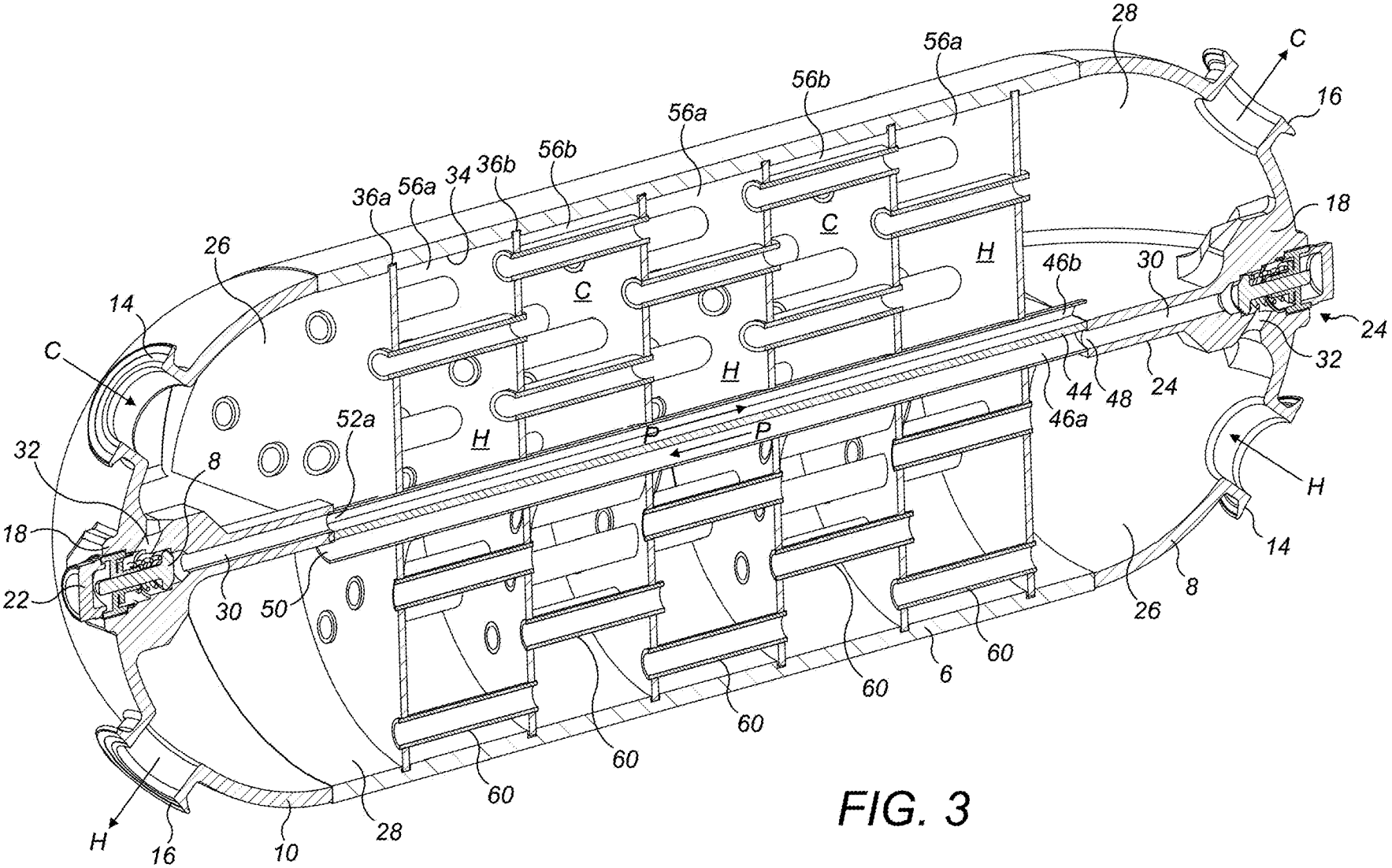
FIG. 3 shows a vertical cross sectional view of the heat exchanger.
Figure 4:
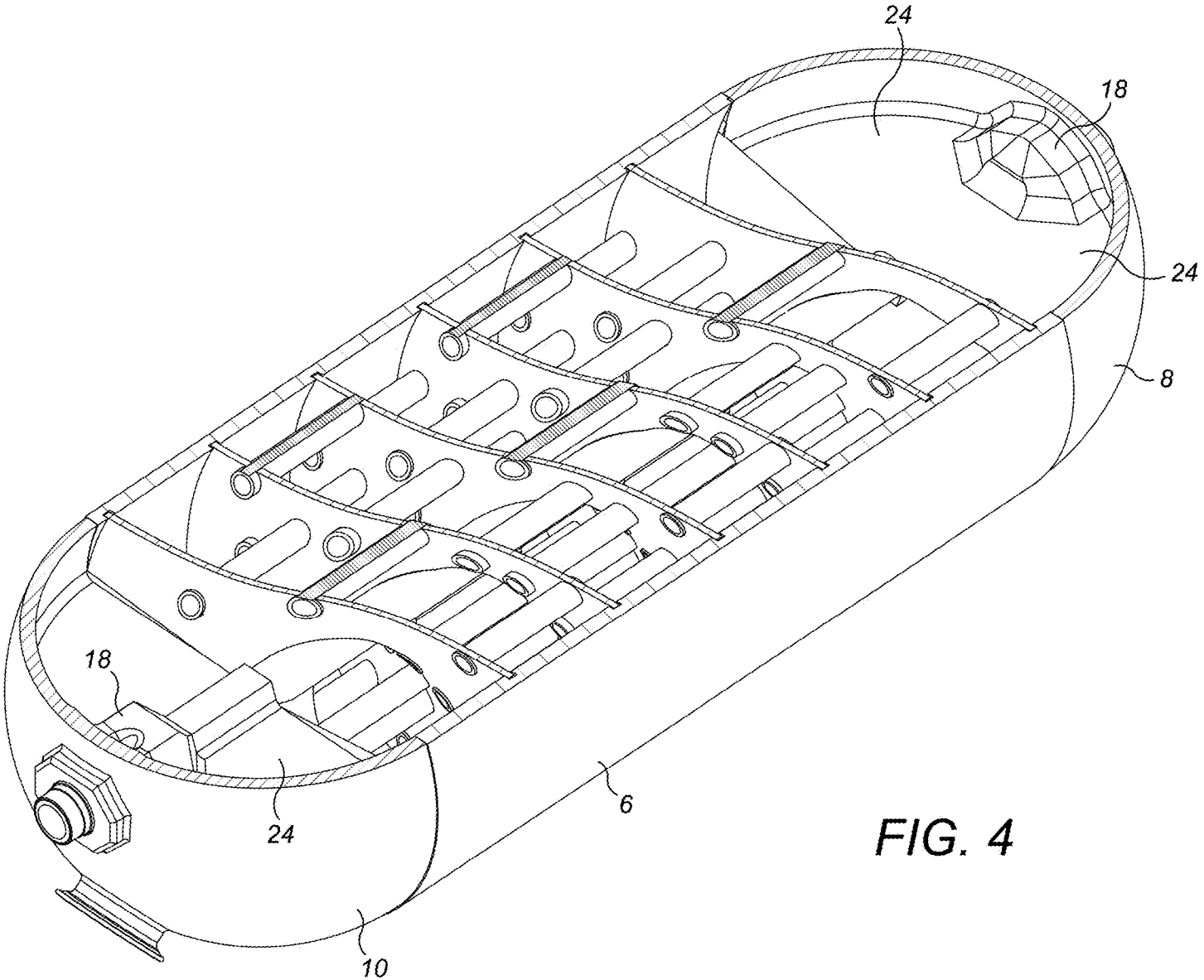
FIG. 4 shows a horizontal cross sectional view of the heat exchanger.
Figure 5:
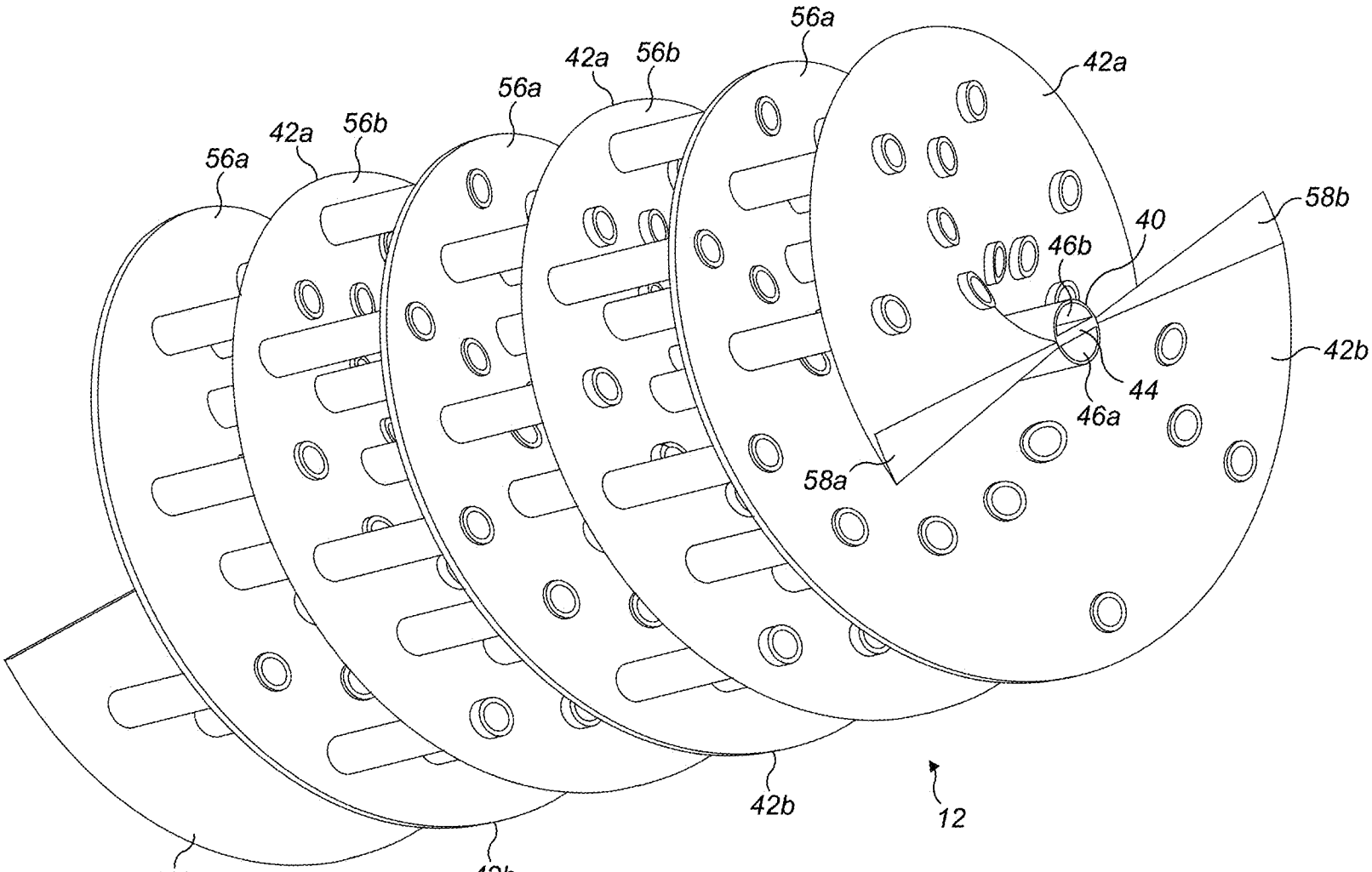
FIG. 5 shows a perspective view of the screw element of the heat exchanger.

With reference to FIGS. 1 to 4, a heat exchanger 2 comprises a shell 4 having a tubular body portion 6 and end caps 8, 10 and a screw element 12 received within the shell 4.

The end caps 8, 10 can be attached to the tubular body portion 6 in any suitable manner, for example by brazing or welding. In the embodiment illustrated, the end caps 8, 10 are hemi-spherical, but other shapes of end cap, such as cylindrical are also within the scope of the disclosure.

The end caps 8, 10 each comprise a fluid inlet 14 and a fluid outlet 16 for connection to first and second fluid flows H, C (hot and cold). The fluid inlets/outlets 14, 16 may be used as either inlets or outlets, depending on the desired direction of flow of the fluids through the heat exchanger 2.

Each end cap 8, 10 also comprises a boss 18 which defines a valve chamber 20 for receiving a pressure relief valve 22, as will be described further below. The end caps 8, 10 also include a dividing wall 24 extending between the fluid inlet 14 and fluid outlet 16 for dividing the respective end regions of the shell 4 and the end caps 8, 10 into first and second plenums 26, 28. As will be described in further detail below, these plenums 26, 28 form inlet and outlet plenums for the first and second fluid flows H, C through the heat exchanger 2.

A valve inlet passage 30 is formed in or on the dividing wall 24, and a valve outlet passage inlet 32 is formed in the boss 18 extending into one of the respective plenums 26, 28 and a bypass flow passage 32 is formed in or on the dividing wall 24 from each respective valve receiving chamber 20.

The inner surface 34 of the tubular body portion 6 is formed with a pair of helical grooves 36*a*, 36*b* for receiving the screw element 12, which will now be described in further detail.

The screw element 12 comprises a core 40 around which extend first and second, nested helical flights 42*a*, 42*b*. The helical flights 42*a*, 42*b* can be integrally formed with the core 40 or formed separately therefrom and suitably mounted thereto for example by welding or brazing. The peripheral edges of the helical flights 42*a*, 42*b* are received in the helical grooves 36*a*, 36*b* of the tubular body portion 6. The screw element 12 may therefore, in effect, be threaded into the tubular body portion 6 during assembly. A braze joint or the like may be provided between the helical flights 42*a* 42*b* and the tubular body portion 6.

The core 40 is hollow, having an internal dividing wall 44 which divides the core into first and second internal passages 46*a*, 46*b*. As will best be seen from FIG. 3, when the screw element 12 is assembled in the shell 4, a first end 48 of the first internal passage 46*a* aligns with and is suitably sealed to the valve inlet passage 30 formed in the first end cap 8. The other end 50 of the first internal passage 46*a* opens into the second plenum 28 of the second end cap 10. Similarly, a first end 52 of the second internal passage 46*b* aligns with and is suitably sealed to the valve inlet passage 32 formed in the second end cap 10. The other end 54 of the second internal passage 46*b* opens into the second plenum 28 of the first end cap 8. The internal passages 46*a*, 46*b* therefore form parts of respective bypass flow paths P through the heat exchanger 2.

The helical flights 42*a*, 42*b* define between them first and second, nested helical flow passages 56*a*, 56*b* along the screw element 12. Each helical flow passage 56*a*, 56*b* is bounded on one side by one of the helical flights 42*a* and on the other by the other of the helical flights 42*b*.

The helical flights 42*a*, 42*b* also have respective end portions 58*a*, 58*b* which, when the screw element 12 is mounted in the heat exchanger are attached and sealed to the respective dividing walls 24 of the first and second end caps 8, 10. In this way, the first helical flow passage 56*a* opens at one end into the first plenum 26 of the first end cap 8 and at the opposite end into the second plenum 28 of the second end cap 10 and the second helical flow passage 56*b* opens at one end into the first plenum 26 of the second end cap 10 and at the opposite end into the second plenum 28 of the first end cap 8. Thus, the first and second flow passages 56*a*, 56*b* are completely separated from one another along their lengths.

While the first and second helical flow passages 56*a*, 56*b* are separated from one another, adjacent turns of the helical flow passages 56*a*, 56*b* are connected by a series of tubes 60. These tubes 60 extend across the other of the helical flow passages 56*a*, 56*b*. In this embodiment, the tubes 60 are arranged parallel to the axis A of the heat exchanger, although other orientations are possible within the scope of the disclosure. In this embodiment, the tubes 60 are circular in cross section, although other cross sectional shapes would fall within the scope of the disclosure. Also, while the cross section of the tubes 60 is shown as being constant along the length of the tube 60, it may vary.

The tubes 60 have inlets 62 for admitting the respective fluids into the tubes 60.

In certain embodiments, the ends of some or all of the tubes 60 may lie flush with the respective helical flights 42*a*, 42*b*, so that the inlets 62 lie in the plane of the flights 42*a*, 42*b*.

In other embodiments, however, the tubes have end portions 64 which project from the flights 42*a*, 42*b*, with inlets 62 being formed in the projecting end portions 64. A number of such configurations are illustrated in FIGS. 6 and 7.

Figure 6:
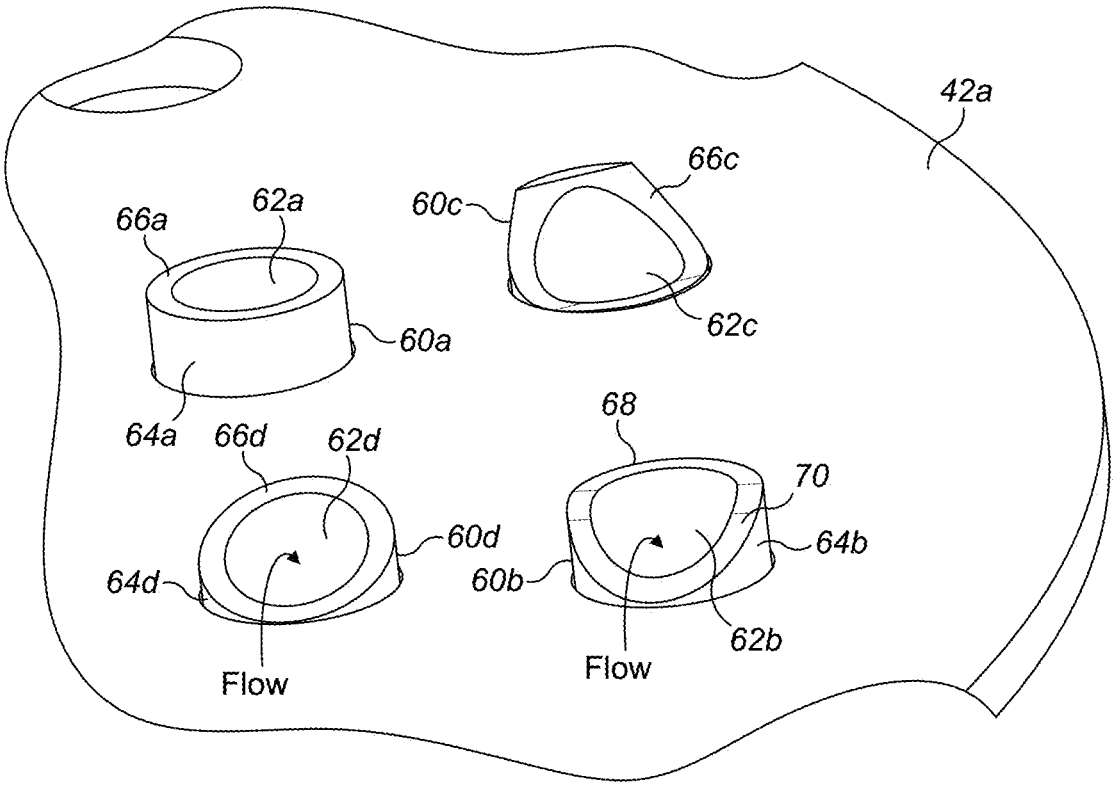
FIG. 6 shows a number of tube end configurations.
Figure 7:
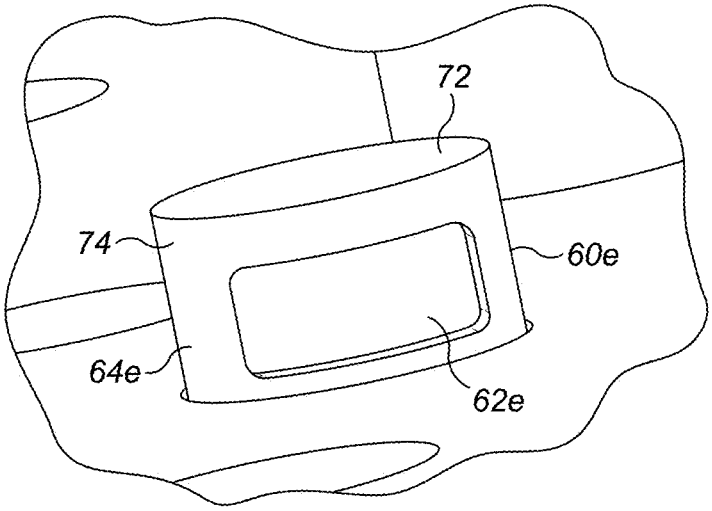
FIG. 7 shows a further tube end configuration

As shown in FIG. 6, in a first example configuration, the end surface 66*a* of a projecting tube portion 64*a* lies generally perpendicular to the longitudinal axis of the tube 60*a*, or parallel to the adjacent surface of the helical flight 42*a*, 42*b*, and the opening 62*a* is formed at the end surface 66*a*.

In a second example configuration, the end surface 66*b* of a projecting tube portion 64*b* has a first portion 68 which lies generally perpendicular to the longitudinal axis of the tube 60*b* and a second portion 70 which is angled thereto. The opening 62*b* formed in the tube therefore has both an axial and a radial (with respect to the tube 60*b*) component. The radial component may be oriented in an appropriate direction relative to the flight axis. It a modification of this arrangement (not illustrated) the end surface portion 68 could also be non-perpendicular to the tube axis, for example sloping away from the second portion 70.

In further example configurations, the entire end surface 66*c*, 66*d* of the projecting tube end portions 64*c*, 64*d* may be angled relative to the axis of the tube 60*c*, 60*d*. The end surface may curved (see surface 66*c*) or planar (see surface 66*d*). Again the openings 62*c*, 62*d* will have both an axial and a radial (with respect to the tube 60*b*) component. The radial component may be oriented in an appropriate direction relative to the flight axis.

In a yet further example configuration, illustrated in FIG. 7, the end of the tube 60*e* is closed by a wall 72. An opening 62*e* is formed in the side wall 74 of the projecting end portion 64*e*. This opening 62*e* therefore has only a radial component (relative to the tube axis).

Also, similar configurations may additionally or alternatively be provided at the outlets to the tubes 60.

The particular configuration and orientation of inlet 62 or tube outlet may be chosen to control the flow of fluid therethrough and to create a desired fluid flow path. For example, in some embodiments, it may be desirable to align the openings 62 with the respective fluid paths along the helical passages 56*a*, 56*b*. Thus inlet openings 62 may for example be aligned to oppose the fluid flow direction so as to receive fluid and outlet openings may aligned with the fluid flow direction.

The tubes 60 may be arranged in any suitable fashion, for example in concentric circular patterns, but other configurations are possible within the scope of the disclosure.

The tubes 60 may be arranged in radially extending rows. The tubes for conducting the first fluid may be arranged radially between the tubes for conducting the second fluid. Alternatively, the tubes for conducting the first fluid and the tubes for conducting the second fluid may be arranged in separate radially extending rows.

The tubes (60) conducting the first fluid may have a greater cross sectional area than those conducting the second fluid. For example the tubes (60) conducting a hot fluid may have a cross sectional area greater than those conducting a cold fluid.

Figure 8:
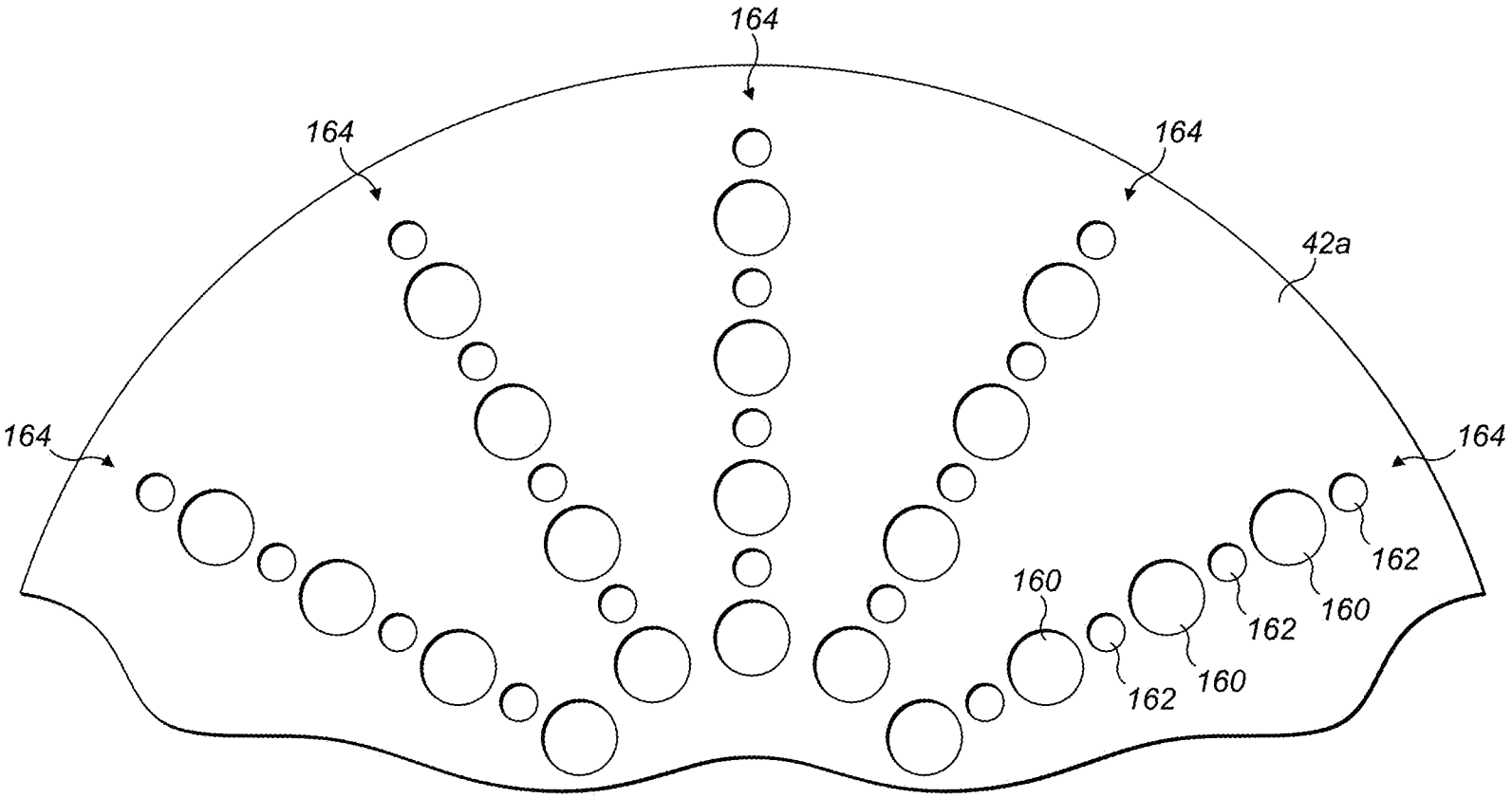
FIG. 8 shows a first exemplary tube configuration.
Figure 9:
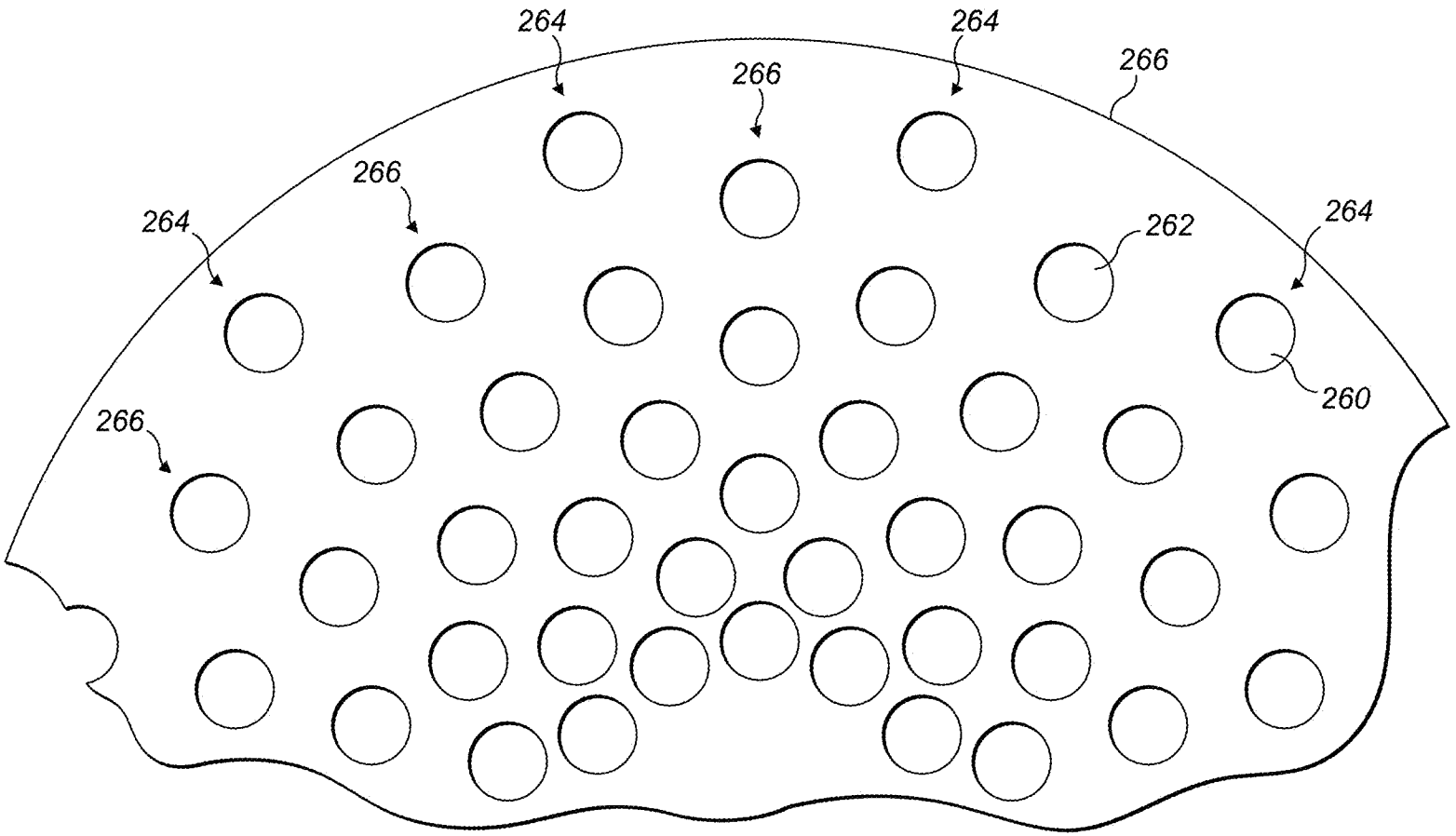
FIG. 9 shows a second exemplary tube configuration.

Two exemplary configurations are shown in FIGS. 8 and 9.

In FIG. 8, tubes 160, 162 are arranged in radially extending rows 164. The tubes 160 conduct a first fluid, for example hot fluid flow H, and the second tubes 162 conduct a second fluid flow, for example a cold fluid flow C. The respective tubes 160, 162 are arranged in an alternating manner in each row 164, i.e. tubes 160 for conducting the first fluid are arranged radially between the tubes 162 for conducting the second fluid and vice versa. The tubes 160 may be positioned, for example, approximately mid-way between the tubes 162.

The tubes 160, 162 in this embodiment are of different diameters, i.e. have different cross sectional areas. However, in other embodiments, the tubes 160, 162 may have the same diameter or cross sectional areas.

In FIG. 9, tubes 260, 262 respectively conduct first and second (for example hot and cold fluid flows H, C). The tubes 260 for conducting the first fluid flow H are arranged in rows 264 and the tubes 262 for conducting the second fluid flow C are arranged in rows 266. Thus the tubes 260 for conducting the first fluid H and the tubes 262 for conducting the second fluid C are arranged in separate radially extending rows 264, 266. The tubes 260 may be positioned, as shown, on different diameters from the tubes 262, for example on a diameter midway between the diameters of the tubes 262.

While the tubes 260, 262 are shown as having the same diameter or cross sectional area in this embodiment, their diameters or cross sectional areas may be different as in the earlier described embodiment.

In the embodiments described above, the rows 164, 264 and 266 are straight. However, these are just exemplary arrangements and in other embodiments, the rows may be curved, providing a spiral type pattern, or have some other configuration.

In the various embodiments described above, the tubes 60, 160, 162, 260, 262 are aligned axially with one another through successive turns of the helical flow passages 56*a*, 56*b*, but that is not essential.

The tubes 60, 160, 162, 260, 262 are suitably mounted to and sealed to the helical flights 42*a*, 42*b* to prevent flow from one helical flow passage 56*a*, 56*b* to the other. The helical flights 42*a*, 42*b* are formed with respective holes 62 to provide inlets and outlets to the tubes 60, 160, 162, 260, 262. The tubes 60, 160, 162, 260, 262 may, for example be welded or brazed to the flights 42*a*, 42*b*.

Figure 10:
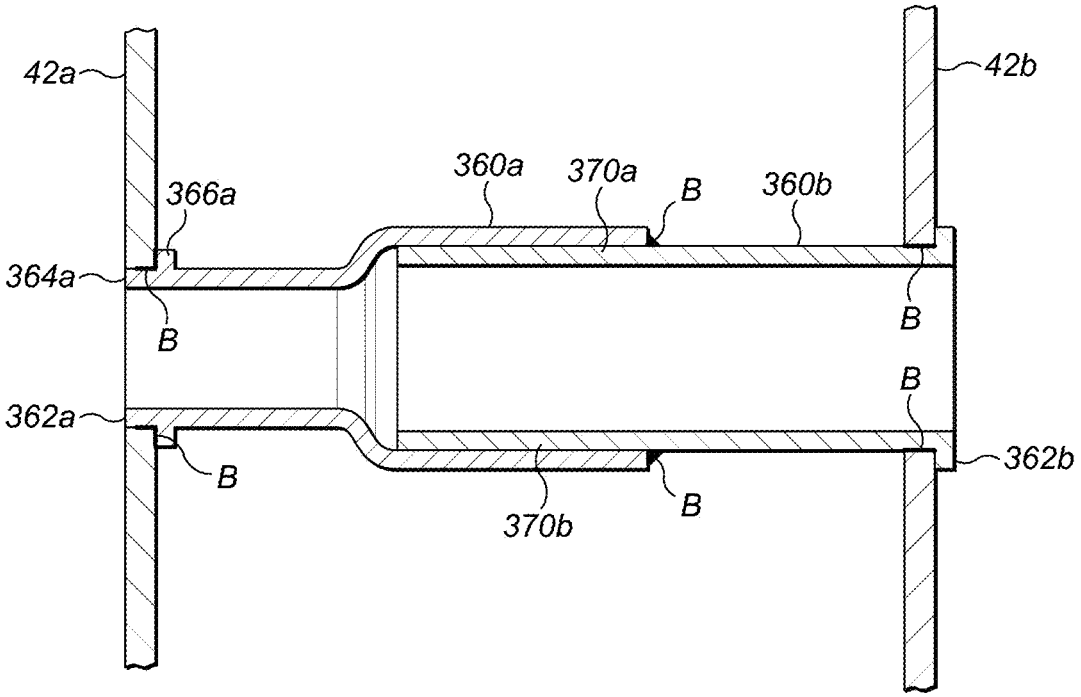
FIG. 10 illustrates a detail of an embodiment of heat exchanger.

In one embodiment, illustrated in FIG. 10, a tube 360 may comprise a first tube portion 360*a* and a second tube portion 360*b*. First tube section 360*a* may comprise a mounting lip 364*a* surrounded by a mounting flange 366*a* at a proximal end 368*a* of the first tube portion 360*a*. The proximal end 368*a* of the first tube portion 360*a* is received from one side within the a hole 362*a* in the flight 42*a* and secured therein for example by brazing B. The distal end 370*a* of the first tube portion 360*a* is formed with a larger diameter than that of the proximal end 364 of the first tube portion 360*a*.

The second tube portion 360*b* has a proximal end 368*b* provided with a mounting flange 366*b* at the end thereof. The diameter of the second tube portion 360*b* is, in this embodiment, constant along its length from the proximal end 368*b* to the distal end 370*b* of the second tube portion 360*b*. The external diameter of the second tube portion 360*b*, at least at its distal end 370*b* is smaller than the internal diameter of the distal end 370*a* of the first tube portion 360*a*, as can be seen from FIG. 10. This will allow the second tube portion 360*b* to be inserted through a hole 362*b* formed in the second helical flight 42*b* up to the mounting flange 366*b* and into the proximal end 370*a* of the first tube portion 360*a*. The second tube portion 360*b* may then be secured to the second helical flight 42*b*, for example by welding or brazing B and if necessary the first and second tube portions 360*a*, 360*b* also secured together and sealed for example by welding or brazing B.

In other embodiments, the tubes 60 may be axially compressible, for example braided or corrugated, to allow them to be inserted between the helical flights 42*a*, 42*b* and then released to engage the helical flights 42*a*, 42*b*.

In yet an alternative embodiment, relatively long tubes may be inserted through a plurality of aligned holes 362 in the helical flights 42*a*, 42*b*, the tubes secured in position, for example by welding or brazing, and then unwanted sections of the tubes removed to produce the desired tube pattern.

Of course these are just examples of tube constructions and other will be apparent to the skilled person. For example, the helical flights 42*a*, 42*b* and the tubes 60, 160, 162, 260, 262 may be formed together by an additive manufacturing process.

The screw element 12 may be preassembled as discussed above before being mounted in the tubular body portion 6 and the end caps 8, 10 then mounted and secured to the tubular body portion 6.

The pressure relief valves 22 may then be mounted in the bosses 18 of the end caps 8, 10 to complete the assembly.

The pressure relief valves 22 in one embodiment may be poppet type valves. The valves 22 may therefore comprise a threaded cap portion 80 received within a threaded bore 82 of the boss 18. The pressure relief valve 22 further comprises a spring loaded valve element 84 which seats against a valve seat 86 in the valve chamber 20 of the boss 18. A valve spring 88 is compressible between a mounting surface 90 of the valve cap portion 80 and a seat 92 on the valve element 84. When closed, the valve element 84 prevents flow from the valve inlet passage 30 to the valve outlet passage 32. However, when open, a flow path is established around the valve element 84 to place the valve inlet passage 30 and valve outlet passage 32 in fluid communication, allowing flow therethrough and allow a respective fluid flow H, C to bypass the heat exchanger 2, as will be described further below.

Having described the construction of the heat exchanger 2 above, its operation will now be described.

In the illustrated embodiment, a first fluid flow H (hot) is connected to the inlet 14 of the first end cap 8 and a second fluid flow C (cold) connected to the inlet 14 of the second end cap 10. The fluid flows H, C are thereby conducted into the respective first plenums 26 formed in the respective end caps 8, 10. From there, the first fluid flow H is conducted along the first helical flow passage 56*a* to the second plenum 28 of the second end cap 10 and the second fluid flow C is conducted along the second helical flow passage 56*b* to the second plenum 28 of the first end cap 10.

As the fluid flows H, C flow along the respective first and second fluid passages 56*a*, 56*b*, heat is transferred from the first fluid flow H to the second fluid flow C through the helical flights 42*a*, 42*b*. The flights 42*a*, 42*b* provide a relatively large surface area for heat transfer. However, it will be appreciated that the respective fluid flows H, C will also pass between adjacent turns of the first and second flow passages 56*a*, 56*b* through the tubes 60. This further acts to transfer heat from the first fluid flow H to the second fluid flow C through the walls of the tubes 60. Thus in the first fluid flow passage 56*a*, heat will pass from the first fluid flow passage 56*a* into the tubes 60 extending thereacross and thereby into the second fluid flow C. In the second fluid flow passage 56*b*, heat from the first fluid flow H within the tubes 60 will pass outwardly through the tube walls into the second fluid flow C in the second fluid flow passage 56*b*. The tubes 60 significantly increase the surface area available for heat transfer between the first and second fluid flows H, C, and may therefore allow for a more compact heat exchanger 2.

Moreover, the tubes 60 create turbulence in the first and second fluid flows H, C as they pass through the first and second helical fluid passages 56*a*, 56*b*, leading to improved heat transfer.

Having passed along the respective helical flow passages 56*a*, 56*b*, the first and second fluid flows H, C exhaust into the second plenums 28 of the first and second end caps 8, 10 from where they are removed via the outlets 16.

In the event that the pressure of one or both of the flows H, C becomes too high (possibly as a result of a blockage within the heat exchanger), the flow will be bypassed around the fluid flow passages 56*a*, 56*b* through the pressure relief valves 20.

During normal operation, the force of the pressure relief valve spring 88 keeps the valve head 84 sealed against the valve seat 86. However, should the inlet pressure build up, the pressure is transmitted from the inlet plenum 26 through one or other of the internal passages 46*a*, 46*b* of the screw element core 40 and the valve inlet passage 30 and will act on the valve head 84, thereby moving it off the valve seat 86 allowing flow to the valve outlet passage 32 and into the outlet plenum 28, thereby bypassing the helical flow passages 56*a*, 56*b*. This will protect the structure of the heat exchanger 2.

It should be noted that the above is non-limiting a description of an embodiment of the disclosure and that modifications may be made thereto within the scope of the disclosure.

For example while in this embodiment, the heat exchanger 2 is shown as a counterflow heat exchanger (the first and second fluids H, C flowing in opposite directions), the heat exchanger could also be a parallel flow heat exchanger in which the fluid flows are in the same direction.

It will also be appreciated that the area for heat transfer could be increased or decreased as necessary by changing the number of tubes 60, the diameter of the tubes 60 and their configuration. It may also be changed by changing the size, thickness, helix angle and pitch of the helical flights 42*a*, 42*b*. The pitch of the helical flights 42*a*, 42*b* could be variable. For example in case of a parallel flow configuration the pitch could be smallest at the inlet end of the heat exchanger 2 and increase gradually along the heat exchanger so as to create a higher pressure drop in the area of the heat exchanger where the temperature differential between the fluid flows H, C is greatest. The use of a double-flighted arrangement may improve volume utilization, providing longer flow paths for both fluid streams. The use of the tubes 60 may further improve volume utilization.

In structural terms, the use of a double flight may also add rigidity and strength to the heat exchanger 2, leading to improved durability.

It will be understood that while the heat exchanger has been illustrated with tubes 60, in certain embodiments these may be dispensed with and the heat exchanger 2 simply have the first and second helical flights (42*a*, 42*b*).

Thus it will be seen that the described embodiment provides a robust, compact design of heat exchanger 2 which can easily be adapted to different heat transfer requirements.

The invention claimed is:

1. A heat exchanger comprising:

a shell having a first inlet and a first outlet for a first fluid (H) and a second inlet and a second outlet for a second fluid (C);

a screw element having a core and first and second nested helical flights mounted to the core and arranged within the shell and defining first and second helical primary fluid passages along the shell between the first and second helical flights, the first primary fluid passage being in fluid communication with the first inlet and the first outlet and the second primary fluid passage being in fluid communication with the second inlet and the second outlet;

a first plurality of tubes mounted between adjacent turns of the first helical fluid passage and extending across the second helical fluid flow passage formed between the adjacent turns of the first helical fluid passage, the first plurality of tubes providing a first secondary fluid passage for conducting the first fluid (H) from one turn of the first fluid passages to the adjacent turn of the first helical fluid passage; and a second plurality of tubes mounted between adjacent turns of the second helical fluid passage and extending across the first helical fluid flow passage formed between the adjacent turns of the second helical fluid passage, the second plurality of tubes providing a second secondary fluid passage for conducting the second fluid (C) from one turn of the second fluid passage to the adjacent turn of the second helical fluid passage.

2. A heat exchanger as claimed in claim 1, wherein the tubes are arranged in concentric circles around the axis of the screw element.

3. A heat exchanger as claimed in claim 1, wherein the tubes are arranged in radially extending rows.

4. A heat exchanger as claimed in claim 3, wherein tubes for conducting the first fluid (H) are arranged radially between tubes for conducting the second fluid (C) in the same row or wherein tubes for conducting the first fluid (H) and the tubes for conducting the second fluid (C) are arranged in separate radially extending rows.

5. A heat exchanger as claimed in claim 1, wherein the tubes between successive respective turns are aligned axially.

6. A heat exchanger as claimed in claim 1, wherein the tubes are flexible or deformable.

7. A heat exchanger as claimed in claim 1, wherein the tubes are formed in two parts, joined together.

8. A heat exchanger as claimed in claim 1, wherein at least one end a tube projects from the surface of an adjacent flight element and an opening is formed in the projecting portion of the tube end.

9. A heat exchanger as claimed in claim 8, wherein the opening is formed in the projecting portion of the tube end is aligned with a direction of the fluid flow through a helical passage into which it extends.

10. A heat exchanger as claimed in claim 1, wherein the shell comprises first and second end caps, the inlets and outlets being formed in the end caps.

11. A heat exchanger as claimed in claim 10, wherein the end caps comprise a wall which divides the end cap into first and second plenums.

12. A heat exchanger as claimed in claim 1, comprising a bypass path (P) for one or both of the first and second fluid flows (H, C).

13. A heat exchanger as claimed in claim 12, wherein the bypass path (P) is formed through the screw core.

14. A heat exchanger as claimed in claim 13, wherein the screw core comprises first and second internal passages, each forming a portion of the bypass path (P).

15. A heat exchanger as claimed in claim 12, comprising a pressure relief valve arranged in the bypass path (P).

16. A heat exchanger as claimed in claim 15, wherein the pressure relief valve is mounted in an end cap.

17. A heat exchanger as claimed in claim 1, wherein the internal surface of the shell is formed with helical grooves to receive the helical flights.

18. A heat exchanger comprising:

a shell having a first inlet and a first outlet for a first fluid (H) and a second inlet and a second outlet for a second fluid (C); and a screw element having a core and first and second nested helical flights mounted to the core and arranged within the shell and defining first and second helical fluid passages along the shell between the first and second helical flights, the first fluid passage forming a first primary flow path for conducting the first fluid (H) and being in fluid communication with the first inlet and the first outlet and the second fluid passage forming a second primary flow path for conducting the second fluid (C) and being in fluid communication with the second inlet and the second outlet; and a plurality of tubes mounted between adjacent turns of each of the first and second helical flights and extending across the fluid passage formed between the adjacent turns of each of the helical flights, the plurality of tubes forming a secondary flow path for conducting the first and or second fluid (H, C) from one turn of the first and second fluid flow passages to the adjacent turn of the first and second flow passages, wherein the secondary flow path through the plurality of tubes for conducting the first and or second fluid (H, C) is transverse to the first and or second primary flow path for conducting the first and or second fluid (H, C).

* * * * *